US008381326B2

(12) United States Patent
Rivas

(10) Patent No.: US 8,381,326 B2
(45) Date of Patent: Feb. 26, 2013

(54) STEAM BATH AND RESISTANCE SYSTEM EMPLOYED

(76) Inventor: Donato Antonio Padilla Rivas, San Cristobal (DO)

( * ) Notice: Subject to any disclaimer, the term of this patent is extended or adjusted under 35 U.S.C. 154(b) by 118 days.

(21) Appl. No.: 12/539,403

(22) Filed: Aug. 11, 2009

(65) Prior Publication Data

US 2009/0300836 A1 Dec. 10, 2009

Related U.S. Application Data

(63) Continuation of application No. 11/563,026, filed on Nov. 23, 2006, now abandoned.

(30) Foreign Application Priority Data

Nov. 23, 2005 (DO) ..... 2005000239

(51) Int. Cl.
*A61H 33/06* (2006.01)

(52) U.S. Cl. ..... 4/524

(58) Field of Classification Search ..... 4/524, 531; 607/81–83

See application file for complete search history.

(56) References Cited

U.S. PATENT DOCUMENTS 3,476,913 A * 11/1969 Berve et al. ..... 392/356
3,772,713 A * 11/1973 Roullier ..... 4/524
4,031,573 A 6/1977 Romanoff
5,471,034 A * 11/1995 Kawate et al. ..... 219/485

FOREIGN PATENT DOCUMENTS

| | | | |
|---|---|---|---|
| CH | 676199 | A5 | 12/1990 |
| DE | 4001778 | A1 | 7/1991 |
| DE | 4226689 | A1 | 2/1994 |
| DE | 19609128 | A1 | 9/1997 |
| DE | 10351263 | A1 | 6/2005 |
| FI | 884714 | A | 4/1990 |
| FI | 884726 | A | 4/1990 |
| JP | 1118022 | A | 5/1989 |
| JP | 8199834 | A | 8/1996 |
| JP | 2002272806 | A | 9/2002 |

* cited by examiner

*Primary Examiner* — Lori Baker
(74) *Attorney, Agent, or Firm* — Luis Figarella

(57) ABSTRACT

A Steam Bath And Steam Generating Unit has a steam generating unit comprised of a housing, a module or system comprised of stainless steel plates affixed inside said housing, two electric poles that supply the module with 120 volts or 240 volts making it possible for the water delivered by the a water regulator in the form of drops to make contact with the plates, where steam is generated and goes out from the steam generating unit through at least one steam outlet. Said steam generating unit also has a water level regulator inside the steam generator and a manual drainage that allows draining the water held in the interior of the steam generator every time it is used.

10 Claims, 3 Drawing Sheets

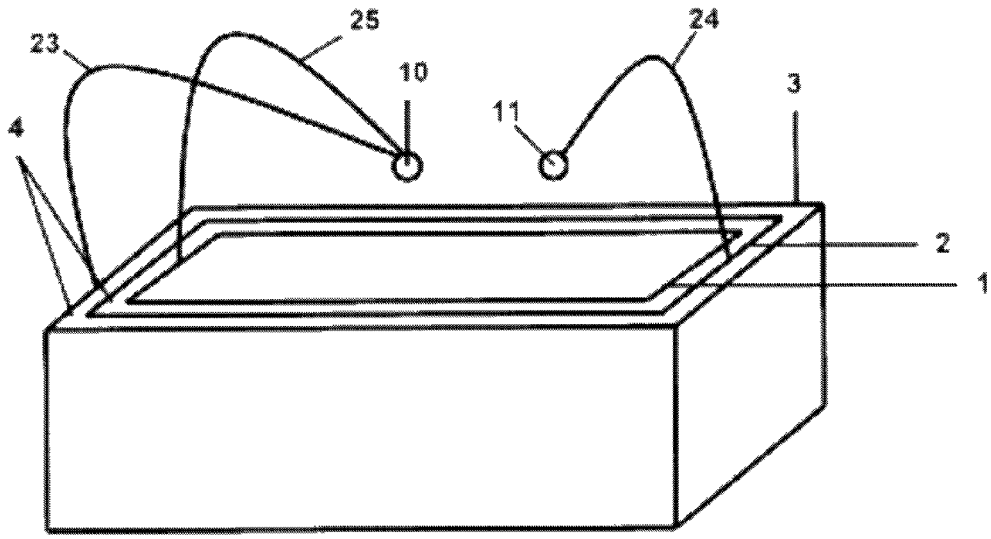
Figure 1
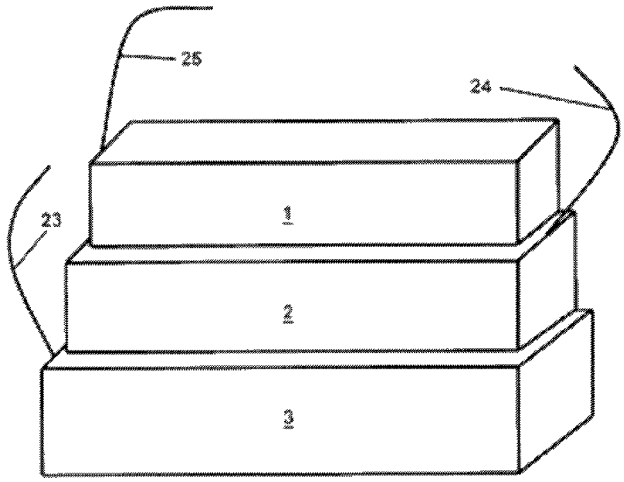
Figure 1.1

STEAM BATH AND RESISTANCE SYSTEM EMPLOYED

CROSS-REFERENCE TO RELATED APPLICATIOTECHNICAL FIELD

The present application claims the benefit, under 35 U.S.C. 120, as a continuation (CON) of U.S. non-provisional application Ser. No. 11/563,026, filed Nov. 23, 2006 now abandoned, entitled "Steam Bach and Resistance System Employed," which application is incorporated herein by reference.

TECHNICAL FIELD

The present invention relates to a steam generating unit that has a system of stainless steel plates to generate water steam to be used for steam baths, among other applications. This device reduces the energy and water consumption, and produces great volume of steam for these kinds of applications in a short period of time. Due to its characteristics, it can be also placed in houses, gyms, offices, etc.

BACKGROUND

It is widely known that steam baths have been used for many years because of its excellent therapeutic properties and body relaxation properties; and especially for its application to eliminate toxins from the body by means of sweating stimulated by the action of water steam generally used in these types of devices.

In the state of technique, it is known the solutions related to saunas, Turkish baths, and steam baths, where energy is obtained from different sources like infrared sources, lights, or lamps (preferably halogen lamps), and electric resistances; the latter being used the most. Particularly, it is reported and known the heating devices (resistances) for generating steam used in the construction of steam baths, which is the object of the present invention.

The patent U.S. Pat. No. 4,031,573, with publication date 1977 Jun. 28, whose applicant is ROMANOFF PAUL IRA, shows a device for the steam generation composed by an electrical heater that generates enough heat to evaporate the water contained in a tray placed on the mentioned heater. The main difficulty of this device lays on the time needed to evaporate the water in the tray what, certainly, will increase the energy consumption.

In the patent JP1118002, publication date 1989 May 10, whose applicant is YOOZEFU BARUTOHAAZARU ARUNORUT, a steam generator to be used in steam baths is claimed, that is composed by a resistance or heating element placed in the water to the boiling point. The main difficulty here is the high energy consumption and time consuming process to turn water into steam.

In the patent FI884726, publication date 1990 Apr. 14, whose applicant is HELO TEHTAAT OY, it is claimed a system (electric stove) of the type used for steam baths, that has electric resistances to generate the heat needed to evaporate water. However, the main disadvantage of this system is the high energy consumption, since the attached temperature regulating system requires incorporating more water depending on the steam demands.

In the patent FI884714, publication date 1990 Apr. 14, whose applicant is HARVIA PERTI KALEVI, a system of resistance that works independently is claimed. That is to say, the system does not use different voltage energy, and also it is necessary to be under water, what increases the consumption of both, water and energy; and a significant increase of time in the heating process to turn water into steam.

In the patent CH676199, publication date 1990 Dec. 28, whose applicant is KURZ RUDOLF GMBH & CO, it is claimed a device characterized by the fact that steam is obtained by means of the immersion of the heating device in a water container. Producing the steam needed from water, it is required a high consumption of energy to turn water into steam. The system of introduction or immersion of the heating device in a water container has a general problem, and it is that the device must be submerged in water without being heated to prevent its breaking when contacting with the cold water surface. So, the energy consumption to turn water into steam increases.

DANNENMANN GUDRUM, who is the applicant of the following patents: DE4001778, publication date 1991 Jul. 25; DE4226689, publication date 1994 Feb. 17; and DE4328376; uses a device to generate steam for a steam bath, but it has a main disadvantage, and it is that the electrical heating element is installed in the water container and it is necessary to heat all the water in the deposit up to turn it into steam. So, this process requires time and high energy consumption.

In the patent JP8199834, publication date 1996 Aug. 6, whose applicant is MITSUI MINING CO LTD, it is claimed a resistance system, that just like the others already described, requires to be submerged in water before being heated, to evaporate water and turn it into steam. Then, this patent presents the same disadvantage already mentioned in the other patents that comprehend the known state of technique.

In the patent DE19609128, publication date 1997 Sep. 11, whose applicant is KLAFS SAUNABAU, it is claimed a system of resistances working under the principle of heating a ceramic surface, what is quite a substitute for some other experiences where different kind of rocks (preferably volcanic) are used; yet it has a difficulty: a high energy consumption is needed to heat a ceramic surface, and the impossibility to use different voltages.

In the patent JP2002272806, publication date 2002 Sep. 24, whose applicant is TANAKA YASUHIDE, it is claimed a system of resistances used to generate steam, but has a disadvantage: it is necessary to submerge the resistance in the water before being heated, what increases the consumption of water and energy, without eliminating the risk of breaking the resistance in the water container if it does not contain the proper volume of water. Also, the systems of resistances that work submerged in water require a long time to turn water into steam by means of heating.

In the patent DE10351263, publication date 2005 Jun. 2, whose applicant is RUKU GMBH & CO KG, it is claimed a steam generator unit to be used in steam baths. This unit possesses a container full of water that is evaporated using the heat produced by the heating unit. The steam generator unit is not placed inside the recipient, but at the bottom of the container; so, it is necessary to generate heat enough to turn water into steam. Then, the main difficulty comes to be the high energy consumption.

Generally speaking, resistances used in steam baths have the following general difficulties:

a) Existing and known resistances for the generation of steam are generally submerged in a water containers or deposits which are fed through a continues flow of water or, on the contrary, via communicating vases, allowing resistance to be connected to water to avoid overheating when getting red hot through contact with electricity and prevent breakage when water is incorporated.

b) The fact that the device is submerged in a container permanently containing water increases time for water to reach required temperature to convert water into steam.

c) Due to the fact that the heating element is submerged in a water container, if amperage rating is 25, the device will reach its maximum ampere capacity as soon as it comes in contact with water, thus producing a continues high power consumption.

d) For the above mentioned traditional systems to be connected to 120v to 240v a current adaptor is required. Otherwise, the device will sustain damage.

e) These systems must be connected with water and have adequate grounding and generally has to be connected to 240v due to the high amperage required by the device.

As everyone knows, most of the end-users of these devices do not afford enough time for a steam bath and systems which would allow them to take a quick and effective steam bath with low power and water consumption at their offices, gyms or at home would be a solution in their practical and economic aspects. This kind of solution is not included in present state of the art.

SUMMARY OF THE INVENTION

An Object of the Present Invention Comprises a System of Resistances for the Production of Vapor, which May be Used in Steam Baths, with an Optimal Yield with Regards to Energy and Water Consumption.

Steam bath and steam bath type resistance system (5) employed, composed by three rectangular base prisms with open bases, placed one into the other where the two first prisms (1) and (2) generate 120v and when third prism is placed, (3) 240v are generated at the same time. Such prisms are placed one into the other and separated by a special plastic or insulating material. This device is placed in a fiberglass container or case (16) and fixed to its base through a fastening system (6). No water is necessary for connection of this device to electricity. Water is introduced into the system by the water drop (13) and water application is regulated by a water proportioning device (14) which will increase or decrease power consumption rate according with the number of water drops in contact with the resistance. Resistance system is used in a steam bath booth made of treated American wood or cedar and it is provided with a ventilation system (17), seat (18) for one or two persons, refuse deposit (19), a reserve water deposit (20) and water inlet system (21).

BRIEF DESCRIPTION OF THE DRAWINGS

The object of this invention consists of a resistance system for the production of steam which can be used in steam baths with a maximum performance as far as energy and water consumption is concerned.

Figures show;

FIG. 1 shows a side view of the resistance system.

FIG. 1.1 shows an expanded view of the resistance system.

Figure 2:
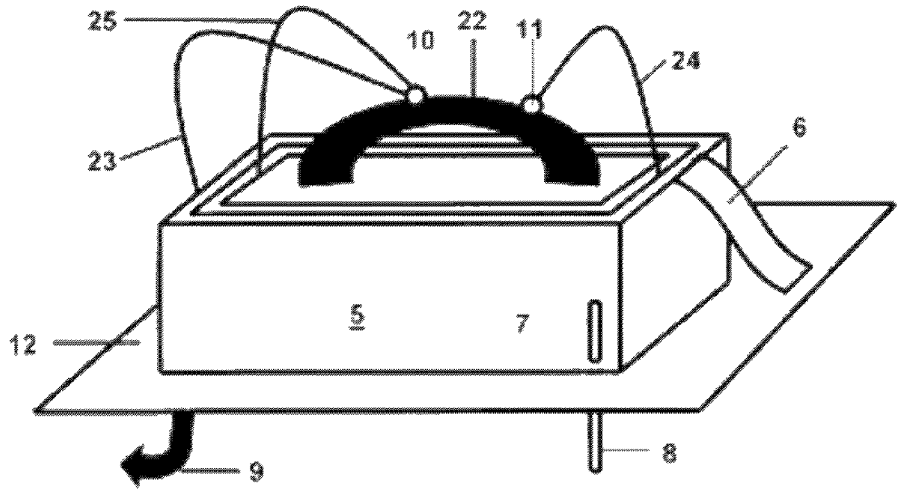
FIG. 2 shows a view of the resistance system, base for the electrical poles and fastening system.
Figure 3:
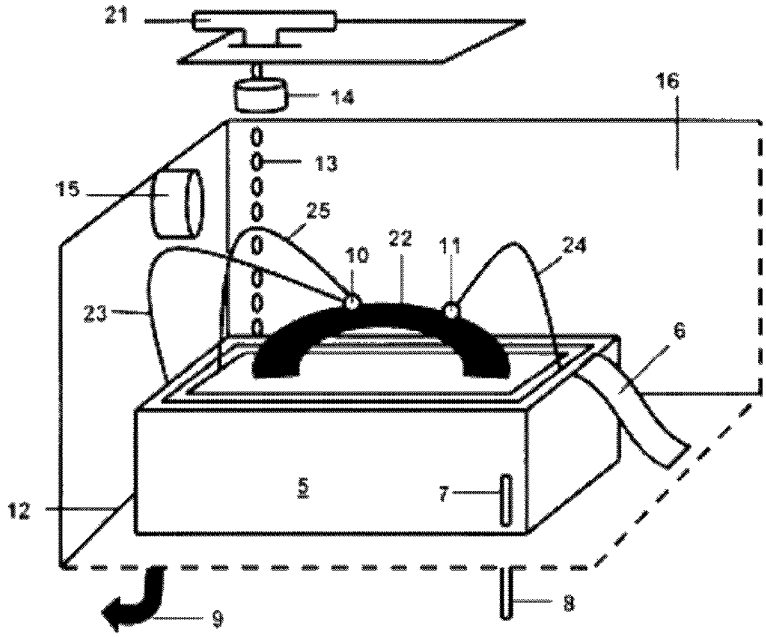
FIG. 3 shows a full view of the resistance system and the water dripping system.
Figure 4:
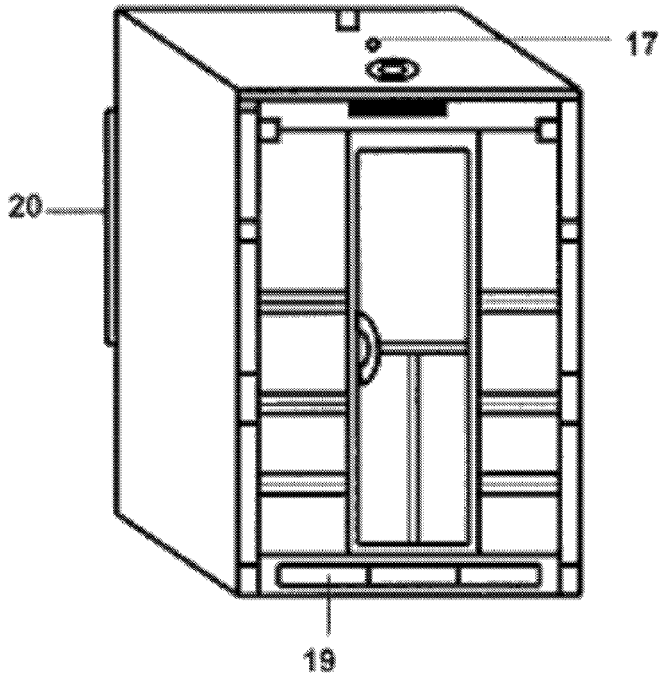
FIGS. 4 and 5 show a diagonal view of the booth or steam bath.
Figure 5:
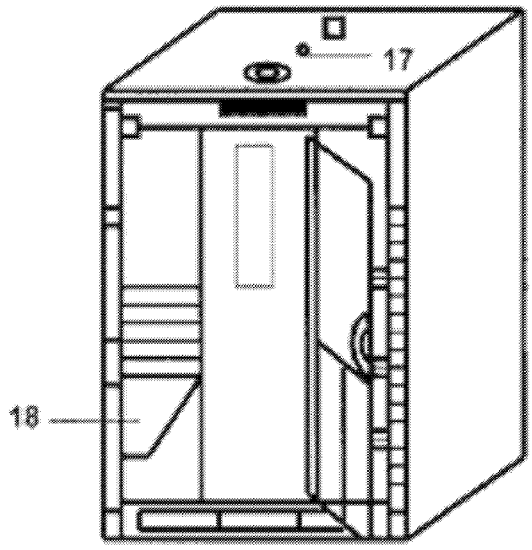

Resistance system in question is made up by 3 rectangular base prisms, with open bases, consisting of different dimensions stainless steel sheets (1), (2) and (3), as shown in FIGS. 1 and 1.1 bent in rectangular shape, forming rectangular prisms, allowing the first two (1) and (2) prisms to generate 120v and a third prism which generates 240v at the same time.

Such rectangular prisms are placed one inside the other and must be separated by a special plastic or insulating material (4), and have a base (22) for electrical poles (10) and (11).

These resistances are placed in a fiberglass case or container (16) which has water inlet (21), steam outlet (15), manual drain (9), drain pipes (7,8), bottom (12), and gravity and/or automatic water control system.

The resistance system for the production of water steam has following advantages over those systems known in present state of the art:

1. The device can be dry-connected without the risk that the resistance, after, heating, fragments when coming in contact with water.

2. In spite of being made from stainless steel, the resistance never gets red-hot with electricity, which permits resistance walls to be durable.

3. Water application is by the drop and controlled by a device which will increase or decrease power consumption, depending on the number of drops in contact with the resistance and the decreasing speed rate of the drops. This will result in savings of water since a permanent water container is not needed.

4. Time saving in the generation of steam, since one or more water drops evaporate becoming water steam faster than water accumulated in a container.

5. The fact that the resistance can be dry-connected to electricity (without water), will allow that the amperage will start from 0 and as the number of water drops is introduced into the system, the amperage will gradually go up until reaching between 8 and 10 (maximum) at 120v and since the resistance can be connected to 240v, the amperage will drop to 3 or 4 amperes.

This water steam generating device is employed in a cedar or American treated pine steam bath. This steam bath is provided with: Ventilation system (17), lighting, aromatic essence compartment, seats (18) for one or two persons, automatic drain, refuse deposit (19), and reserve water deposit (20) to be applied to the system by the drop.

Manufacturing features that allow this invention to be brought to practical purposes are shown as an illustrative, but no limitative example, as follows:

A resistance made up by three rectangular base prisms with open bases made of stainless steel 24 gauge sheets, where the sheet that forms the outside rectangular base prism (3) has dimensions of 16.5 cm long .time. 5.5 cm wide .times.4.2 cm high; the sheet that make up the intermediate rectangular base prism (2) measures 15.5 cm long .times.5.0 cm wide .times.4.2 high, and the inside rectangular base prism (1) has 15 cm long .times.4.5 cm wide .times.4.2 cm high These rectangular base prisms must be separated one from the other by a special plastic or insulating material (4).

This device is placed in a fiberglass container or case (16) which measures 7½" long .times.3" wide .times.5" high, and is has a water inlet (21) provided with a discharge pipe in a water proportioning device (14) for water drops (13), a steam outlet (15) connected to the booth, manual drain, and an automatic and gravity water control system.

Dimensions of a booth made of cedar or American treated pine for one person are 80" high .times.37" wide .times.30" depth.

The device is plugged to electricity for use and immediately starts generating water steam through water drops falling on the resistance. If desired, some aromatic essence may be added to water for the pleasure of the person using the steam bath.

Other examples of how to make the steam generator could be a module or system of stainless steel plates (5) comprehending at least two prisms with different configurations, or at least two cylinders made of the same 24 caliber steel, of different sizes, or any other configuration that can be derived from 24 caliber steel rectangular plates, in such a way that can be placed one inside the other, being separated each other by an insulator. It is also necessary to adapt the housing or case (16), made of fiberglass or a similar material, to the new configuration of the module or system of stainless steel plates (5) and to use the same technical principle of water dripping on the module or system of stainless steel plates (5) as the steam generator.

This module or system of stainless steel plates 5 is placed at the bottom 12 of the housing 16 by means of a fixing system 6. The housing 16 is made of fiberglass, plastic, or an equivalent material. It has a base or basis 22 in its central part for the electric poles 10 and 11 driving the system voltage; and through them the module or system of stainless steel plates 5 s energized when connected to the power supply. The housing 16 has also a water input 21, to which a water regulator device 14 is connected that guarantees the water supply in form of drops 13 to the module or system of stainless steel plates 5; at least one steam outlet 15 that permit the exit of the steam resulting from the contact of the water drops 13 and the system of stainless steel plates 5, a manual water drainage 9, a drain pipe (7, 8) to keep a constant water level inside the housing 16. All these parts form the steam generating unit.

The invention claimed is:

1. A steam generator for generating steam from water drops provided by a water proportioning device, said steam generator comprising;

a housing containing a system of stainless steel plates;

said system of stainless steel plates comprising two or more said stainless steel plates, said plates forming continuous perimeter shapes of different sizes placed one inside the another so as to form one or more open top water-holding cavities, wherein each said cavity inner and outer walls are electrically insulated from one another and formed by one or another stainless steel plate; the plates being separated by an insulating material that prevents a contact between the plates, said system of stainless steel plates being configured for receiving 120 volts or 240 volts energy by means of two electric poles connected to an energy source, each said electric pole being connected to an alternating corresponding stainless steel plate via a cable;

each said plate located so that when water drops falling from the water proportioning device accumulate within said cavity so as to close the electrical circuit of alternating powered stainless steel plates, steam is generated and goes out from the steam generator housing through at least one steam outlet;

a water proportioning device placed inside said steam generator housing; and one or more drains openings through said housing.

2. The steam generator of claim 1, wherein;

said stainless steel plates form two or more prisms, placed one inside the other, each prism having at least three sides.

3. The steam generator of claim 1, wherein;

said stainless steel plates form at least two cylinders, placed one inside the other.

4. The steam generator of claim 1, wherein;

water drops within said housing fall between said stainless steel plates; and the number of said water drops is controlled by the water proportioning device.

5. The steam generator of claim 1, further comprising;

a cabin;

a ventilation system;

a seat;

refuse deposit; and reserve water deposit.

6. An apparatus for steam generation comprising;

a steam generation housing;

two or more stainless steel plate prisms, said stainless steel plates having prismatic shapes of different sizes that are placed one inside the other so as to form one or more cavities whose walls are electrically insulated from one another and configured so that each prismatic shape is equipped to receive a the alternating poles of 120 volts or 240 volts energy by means of two or more electric poles connected to an energy source;

each said electric pole being connected to a side of each said cavity so that when water drops falling from the water proportioning device accumulate within said cavity and make contact with the plates forming said cavity the flow of current through the water in said cavity generates steam that goes out of said housing through at least one steam outlet;

a water proportioning device placed inside said steam generator housing; and one or more drainage openings through said housing.

7. The steam generator apparatus of claim 6, wherein;

said stainless steel plates form at least two prisms, placed one inside the other, each prism having three or more sides.

8. The steam generator apparatus of claim 6, wherein;

said stainless steel plates form at least two cylinders, placed one inside the other.

9. The steam generator apparatus of claim 6, wherein;

water drops within said housing fall between said stainless steel plates, and the number of said water drops is controlled by said water proportioning device.

10. The steam generator of claim 6, further comprising;

a cabin;

a ventilation system;

a seat;

refuse deposit; and reserve water deposit.

* * * * *